United States Patent [19]

Houman

[11] Patent Number: 4,490,220

[45] Date of Patent: Dec. 25, 1984

[54] ELECTROLYTIC COPPER PLATING SOLUTIONS

[75] Inventor: John Houman, Oyster Bay, N.Y.

[73] Assignee: LeaRonal, Inc., Freeport, N.Y.

[21] Appl. No.: 604,917

[22] Filed: Apr. 27, 1984

Related U.S. Application Data

[63] Continuation-in-part of Ser. No. 536,811, Sep. 28, 1983, abandoned, which is a continuation of Ser. No. 429,055, Sep. 30, 1982, abandoned.

[51] Int. Cl.[3] ..... C25D 3/38

[52] U.S. Cl. ..... 204/52 R

[58] Field of Search ..... 204/52 R, 44, 106, 123

[56] References Cited

U.S. PATENT DOCUMENTS

| | | | |
|---|---|---|---|
| 2,888,390 | 5/1970 | Lapee | 204/108 |
| 2,954,331 | 9/1960 | Abbott | 204/52 |
| 3,682,788 | 8/1972 | Kardos et al. | 204/52 R |
| 3,804,729 | 4/1974 | Kardos et al. | 204/52 R |
| 4,134,803 | 1/1979 | Eckles et al. | 204/52 R |
| 4,181,582 | 1/1980 | Dahms | 204/52 R |
| 4,347,108 | 8/1982 | Willis | 204/52 R |
| 4,376,685 | 3/1983 | Watson | 204/52 R |

FOREIGN PATENT DOCUMENTS

| | | | |
|---|---|---|---|
| 2406009 | 5/1979 | France | 204/52 R |
| 49-31183 | 8/1974 | Japan | 204/52 R |
| 49-31406 | 8/1974 | Japan | 204/52 R |

*Primary Examiner*—G. L. Kaplan

*Attorney, Agent, or Firm*—Pennie & Edmonds

[57] ABSTRACT

Acid copper electroplating solutions containing the reaction product of (A) a compound containing a nitrogen-carbon-sulfur radical of the general structural formula

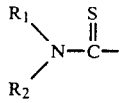

where $R_1$ and $R_2$ are alkyl radicals a hydrogen atom or mixtures thereof, or

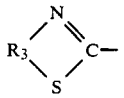

where $R_3$ is an aromatic, heterocyclic or alicyclic radical or their alkyl derivatives, and (B) a compound of the formula $$X—R_1—(S)_n—R_2—Y$$

where $R_1$ and $R_2$ are the same or different and are substituted or unsubstituted alkylene radicals containing 1 to 6 carbon atoms, X is a functional or non-functional moiety, n is 2, 3, 4, or 5, and Y is a water solubilizing group or a group capable of imparting water solubility to the reaction product in a sufficient amount to increase the brightness of the deposit and/or to prevent the formation of cracks during thermal shock. Optionally, an amide of the formula

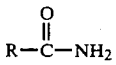

where R is a lower alkyl radical of 1 to 6 carbon atoms, a lower alkylene radical of 1 to 4 carbon atoms, an aromatic radical, or a hydrogen atom can also be reacted with (A) and (B) to produce a reaction product that provides equal or better results.

26 Claims, No Drawings

ELECTROLYTIC COPPER PLATING SOLUTIONS

This is a continuation-in-part of U.S. patent application Ser. No. 536,811 filed Sept. 28, 1983 which in turn was a continuation of U.S. patent application Ser. No. 429,055, filed Sept. 30, 1982 and both now abandoned.

TECHNICAL FIELD

The invention relates to the electrodeposition of copper for decorative use and more particularly to the electrodeposition of copper on substrates having sharp corners such as those formed by holes drilled into copper clad plastic sheet during the production of printed circuit boards.

BACKGROUND OF THE INVENTION

Circuit boards are generally prepared by laminating a copper cladding to both sides of a plastic sheet. This sheet typically is an epoxy-glass material. Holes are then drilled through the copper clad plastic, thus exposing the plastic. This exposed plastic must then be plated to effect conductivity from one side of the board to the other. This is generally accomplished by treating the plastic with an activator by well known processes, subjecting the entire circuit board to electroless deposition of copper to render the treated areas receptive to electrolytic copper depositions, and then plating the board and the internal surfaces of the holes by electrodeposition of copper. The sharp corners formed by the perimeter of the holes adjacent to the top and bottom of the board must also be plated. While this copper plating can be accomplished by many different copper electroplating solutions presently on the market, the copper plate at these sharp corners has a tendency to develop cracks when the boards are subjected to thermal shock which occurs during further processing.

SUMMARY OF THE INVENTION

This invention relates to novel acid copper electroplating solutions containing the reaction product of a compound containing a nitrogen-carbon-sulfur radical and having the following general structural formula

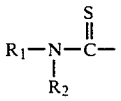

or

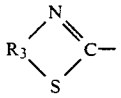

where $R_1$, $R_2$, and $R_3$ are as defined below, and an alkylene polysulfide having at least one terminal sulfonic acid group. Optionally, an amide of the formula

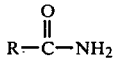

where R is a lower alkyl radical of 1 to 6 carbon atoms, a lower alkylene radical of 1 to 4 carbon atoms, an aromatic radical, or a hydrogen atom can be used as a third reactant to form the desired reaction product.

DETAILED DESCRIPTION

The compounds that can be used to react with the alkylene polysulfide compounds preferably contain one of the nitrogen-carbon-sulfur radicals represented by the following general formulas:

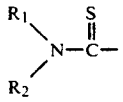

(1)

where $R_1$ and $R_2$ are alkyl radicals, a hydrogen atom or mixtures thereof, or

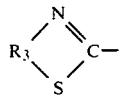

(2)

where $R_3$ is an aromatic, heterocyclic or alicyclic radical or their alkyl derivatives.

$R_3$ and the combination of $R_1$ and $R_2$ may also be cyclic alkyl radicals linking to the single bonds of sulfur and nitrogen in (2) for $R_3$ and the double bond of nitrogen in (1) for the combination of $R_1$ and $R_2$.

The nitrogen-carbon-sulfur organic compounds suitable for the present invention all contain an organic radical which comprises a carbon atom bonded exclusively to hetero atoms, nitrogen, or sulfur. These compounds contain a radical having one of the following structural formulas:

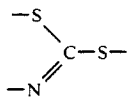

(3)

or

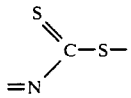

(4)

Linked to one of the sulfur and the nitrogen in (3) may be an aromatic or a cyclic alkyl radical, and to the nitrogen in (4) may be alkyl radicals or cyclic alkyl radicals. The second sulfur is connected to a hydrogen, alkyl, or other nitrogen-sulfur radicals.

Examples of a number of specific compounds coming within the scope of the above formulas are set forth in Column 2 of U.S. Pat. No. 3,414,493 issued to Nobel et al. on Dec. 3, 1968. The disclosure of this U.S. Pat. No. 3,414,493 with regard to the nitrogen-carbon-sulfur compound useful according to this invention is incorporated herein by reference.

The compounds found to be the most advantageous to date are the sodium salts of tetraalkylthiuram disulfide,

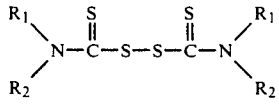

(5)

where $R_1$ and $R_2$ are methyl or ethyl or mixtures thereof, 2,2'-dithio-bisbenzothiazole, (6)

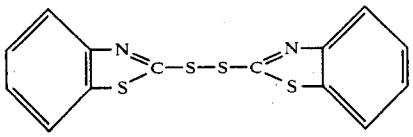

and 2-mecaptobenzothiazole (7)

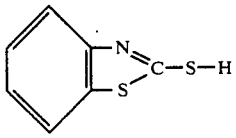

When reacting compounds such as (5) and (6) with sodium hydroxide, the compounds are split, predominantly but not exclusively between the —S—S— bond to form the sodium salts. Thus when a compound according to formula (5) having $R_1$ and $R_2$ as ethyl groups is reacted with sodium hydroxide, it would form predominantly two moles of (8)

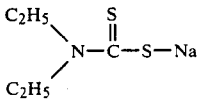

plus minor amounts of (9)

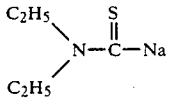

and (10)

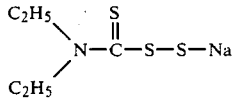

Similarly, reacting formulas (6) and (7) with sodium hydroxide would form (11)

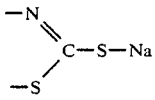

with minor amounts of (12)

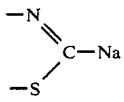

and (13)

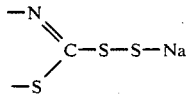

The sodium salts of the compounds (5), (6) and (7) can readily be prepared by known means by heating the compounds dissolved in a solvent such as methanol (preferably with reflux) with sodium hydroxide. The compound of formulas (5), (6) and (7) are available commercially and marketed under the marks TUADS, ALTAX and CAPTAX, respectively, by R. T. Vanderbilt Company, Inc.

The second reactant is an alkylene polysulfide compound having at least one water solubilizing group or a group capable of imparting water solubility to the end reaction product. These compounds correspond to the general formula $$X—R_1—(S)_n—R_2—Y \quad (14)$$

where $R_1$ and $R_2$ are the same or different and are alkylene radicals containing 1 to 6 carbon atoms, x is a functional or non-functional moeity such as hydrogen, a sulfonic acid group, a carboxylic acid group, a hydrocarbon group, etc, n is an integer from 2 to 5, and Y is a water solubilizing group or a group capable of imparting water solubility to the reaction product. It is most advantageous for Y to be a sulfonic acid group, but other water solubilizing groups such as a carboxylic acid group might also be employed.

Examples of a number of specific compounds coming within the scope of the above formula are set forth in column 2 of U.S. Pat. No. 3,328,273 issued to Creutz et al. on June 27, 1967 and which disclosure is incorporated herein by reference. It is preferable to use the alkali metal salts of the above compounds. The exact nature of the X moeity does not constitute a part of this invention and can be most any group so long as it does not interfere with the improved results set forth herein. The alkylene groups can also be substituted but preferably are unsubstituted as set forth in U.S. Pat. No. 3,328,273.

The most advantageous alkylene polysulfide known to date is di(sodium 3-sulfonate-1-propyl) sulfide $$Na—SO_3(CH_2)_3—S—S—(CH_2)_3—SO_3Na \quad (15)$$

Equivalent or better results can be obtained by adding an amide as a third reactant with the two components described above. Examples of these amides are represented by the following formula:

(16)

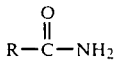

where R is a lower alkyl radical of 1 to 6 carbon atoms, a lower alkylene radical of 1 to 4 carbon atoms, an aromatic radical, or a hydrogen atom. It is especially advantageous to use acrylamide as the alkylene amide compound and third reactant. Other compounds which can be used as the alkylene amide include acetamide, propionamide, benzamide, and the like.

The exact chemical nature of the reaction product from either of these two or three reactants is not known. The products resulting from these reactions are hereinafter referred to as the reaction products.

The invention includes the use of oxyalkylene polymers as brightening and leveling agents in combination with the reaction products. The oxyalkylene polymers have been found to materially increase the brightness and leveling of the deposits. The polyalkylene glycols, such as polyethylene glycols, methoxy polyethylene glycols and the polypropylene glycols, have been found to be particularly advantageous.

The oxyethylene or oxypropylene polymers can be surfactants, anionic, nonionic or cationic. Anionic and nonionic are preferred. These types of surfactants are well known and lists of specific polymers can be obtained by consulting any standard text on the subject such as the various volumes of Kirk-Othmer Encyclopedia of Chemical Technology or the industrial literature. It is the presence of the ethylene oxide or propylene oxide groups that is most important. The compounds should have at least about 8 moles of ethylene and/or propylene oxide and be soluble in the bath solution. Combinations of polyethylene and polypropylene glycols and/or surfactants can also be used.

The amounts of the oxyalkylene polymers can be about the same as is usually employed in acid copper baths. A sufficient amount should, of course, be used to obtain the brightness and leveling desired which will in turn depend on the ultimate use intended. Generally about 0.1 to 0.5 g/l or ml/l can be employed.

Additional brighteners, grain refiners or leveling agents known in the art can also be added to the plating solutions of this invention in addition to or in place of the oxyalkylene polymers as will be apparent to those skilled in the art.

As noted above, the copper deposited according to this invention is useful for decorative purposes, in the electronic industry generally, and for the conduction of electricity on substrates that do not have sharp corners or on articles where thermal shock is not a problem. The amounts of the reaction products employed in the acid copper plating solutions may therefore differ depending on the result desired, but in any event the amounts should be sufficient to improve the brightness and smoothness of the metallic deposits over that obtainable from the basic plating solutions.

When plating a substrate having sharp corners, such as circuit boards which are subjected to thermal shock, the amounts of reaction products should be sufficient to prevent cracks in the deposit at the corners when the plated substrate is subjected to thermal shock. As far as it is known today, the amounts to accomplish both of these results will be substantially the same. Small amounts, as little as about 0.1 ml/l , have been found sufficient to accomplish this purpose. Larger amounts, such as 1 ml/l, can of course also be employed so long as it does not adversely affect the plating operations or the advantages of this invention. No upper limit has been determined. It is, of course, advantageous to use as little of reaction product as practicable to obtain the desired results.

The acid copper plating solutions to which the reaction products can be added are conventional and well known. The two essential constituents are a copper salt, such as copper sulfate, and an acid, such as sulfuric acid. The salt furnishes the metal ions and the acid serves to reduce the resistivity or promote conductivity. These baths typically contain between about 70–250 g/l of copper sulfate, 30 to 250 g/l of sulfuric acid, and 50-100 ppm of a chloride ion.

The reaction products can be formed by dissolving compounds of formulas (1) and/or (2), such as a tetraalkylthiuram disulfide sodium salt in a suitable solvent, and adding a bis(3-sulfoalkyl) disulfide salt to the reaction mixture with or without the acrylamide compound under reflux. Concentrated sulfuric acid is then added (dropwise in the laboratory) during the reflux and continued until gassing has ceased or no precipitate or turbidity is present. The reactants can be any of the mixtures described above.

EXAMPLE 1

2.6 g of tetraethylthiuram disulfide is dissolved in a sufficient amount of methanol and 0.78 g of sodium hydroxide. The reaction mixture is refluxed for 30 minutes to complete the reaction and the volume of the resulting solution is increased by 50% to 100% with water to clear it from turbidity. 3.52 g of bis(3-sulfopropyl) disulfide disodium salt and 8.0 g of acrylamide are then added while continuing the reflux for about 30 minutes to an hour. Concentrated sulfuric acid is added dropwise during the reflux and continued until no more gassing or precipitate or turbidity is present. The color of the solution, during the sulfuric acid addition, changes from a dark greenish-yellow to pale yellow-colorless. The reaction product is then diluted with water to a volume of 1 liter.

The exact proportions of the reactants are not very critical but best results to date are obtained by using stoichiometric amounts. The reaction can include additional reactants so long as they do not affect the function and advantageous properties of the resulting reaction product. For example, 0.6 g of formaldehyde can be added to the methanol solution and reacted with the sodium hydroxide before the addition of the disulfide compound and the resulting reaction product has substantially the same advantageous properties.

EXAMPLE 2

The procedure of Example 1 was followed except that the acrylamide was omitted from the reaction.

EXAMPLE 3

A 2 gallon tank and a Hull cell was used on an acid copper plating solution of the following composition:

| | |
|---|---|
| Copper Sulfate | 75 g/l |
| Sulfuric Acid | 188 g/l (10% by vol.) |
| Chloride | 85 ppm |
| Reaction product of Example 1 | 0.125 ml/l |

The plating bath was operated at 75° F. in a Hull cell with air agitation at a current of 2 amps for 10 minutes. The plating bath in the 2 gallon tank was operated at identical parameters, but at a current density of 15 ASF for an hour.

Printed circuit boards with the holes drilled therein after being activated and electrolessly plated with copper were plated in this tank. The copper deposit on the circuit board was smooth and semi-lustrous over current density range of 2 to 20 ASF and showed no signs of corner cracks after thermal shock.

EXAMPLE 4

The procedure of Example 3 was followed except that the following material was also incorporated into the plating bath:

| | |
|---|---|
| Polyethylene Glycol (Carbowax 14000) | 0.375 g/l |

The copper deposit on the plated material was very bright and levelled over a current density range of from 1 to 100 ASF and showed no signs of corner cracks after thermal shock.

EXAMPLE 5

The procedure of Example 3 was followed except that the following materials were also incorporated into the plating bath:

| | |
|---|---|
| Polyethylene Glycol (Carbowax 14,000) | 0.375 g/l |
| Polypropylene Glycol 410 | 0.0425 ml/l |

The deposit on the plated material was very bright and levelled in the current density range of from 1 to 100 ASF. The deposit on the printed circuit board plated in the 2 gallon tank was very bright and leveled and showed no signs of corner cracks after thermal shock.

The thermal shock test to which the plated boards are subjected in the above examples is conventional. After the boards are baked for about an hour at 150° C., they are cooled to room temperature and allowed to float on one side in molten solder at 288° C. for 10 seconds, then turned over and allowed to float on the solder on the other side for 10 seconds. The boards are then removed and inspected for cracks.

EXAMPLE 6

The procedure of Example 5 was followed except that the reaction product of Example 2 was submitted for the reaction product that was used in Example 5. The deposit on the plated material was very bright and levelled in the current density range of from 1 to 100 ASF.

I claim:

1. An acid copper electroplating solution comprising a soluble copper salt, free acid and a reaction product of (A) a compound containing a nitrogen-carbon-sulfur-radical of the general structural formula

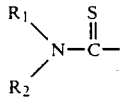

where $R_1$ and $R_2$ are alkyl radicals, a hydrogen atom or mixtures thereof, or

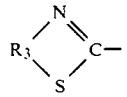

where $R_3$ is an aromatic, heterocyclic or alicyclic radical or their alkyl derivatives, and (B) a compound of the formula $$X—R_1—(S)_n—R_2—Y$$

where $R_1$ and $R_2$ are the same or different and are substituted or unsubstituted alkylene radicals containing 1 to 6 carbon atoms, X is a functional or non-functional moeity, n is 2, 3, 4, or 5, and Y is a water solubilizing group or a group capable of imparting water solubility to said reaction product, said reaction product being present in a sufficient amount to increase the brightness of the deposit and/or to prevent the formation of cracks during thermal shock.

2. The electroplating solution of claim 1 wherein Y of said alkylene polysulfide compound is an $—SO_3H$ group.

3. The electroplating solution of claim 2 in which (A) is an alkali metal salt of tetraalkylthiuram disulfide, 2,2'-dithio-bis-arylthiazole, or 2-mercaptoarylthiazole and (B) is di(3-sulfonate-1-alkyl) sulfide.

4. The electroplating solution of claim 3 containing a brightening and/or leveling agent.

5. The electroplating solution of claim 4 in which the agent is an oxyethylene and/or an oxypropylene polymer containing at least about 8 ethylene or propylene groups.

6. The electroplating solution of claim 2 in which (A) is the sodium salt of tetramethylthiuram disulfide, tetraethylthiuram disulfide or mixtures thereof, 2,2'-dithiobisbenzothiazole or 2-mercaptobenzothiazole and (B) is di(sodium-3-sulfonate-1-propyl) sulfide.

7. The electroplating solution of claim 6 containing a brightening and/or leveling agent.

8. The electroplating solution of claim 7 in which the agent is an oxyethylene and/or an oxypropylene polymer containing at least about 8 ethylene or propylene groups.

9. The electroplating solution of claim 1 in which the reaction product is prepared from the reaction of (A), (B) and an amide.

10. The electroplating solution of claim 9 wherein Y of said alkylene polysulfide compound is an $—SO_3H$ group.

11. The electroplating solution of claim 10 in which the copper salt is copper sulfate and the free acid is sulfuric acid.

12. The electroplating solution of claim 9 wherein said amide is a compound of the formula

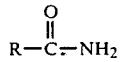

where R is a lower alkyl radical of 1 to 6 carbon atoms, a lower alkylene radical of 1 to 4 carbon atoms, an aromatic radical, or a hydrogen atom.

13. The electroplating solution of claim 12 containing a brightening and/or leveling agent.

14. The electroplating solution of claim 13 in which said agent is an oxyethylene and/or an oxypropylene polymer containing at least about 8 ethylene or propylene groups.

15. A method of electroplating acid copper solutions on substrates having sharp corners to prevent the formation of cracks at the corners due to thermal shock which comprises electroplating the substrate with solution containing a copper salt, free acid and the reaction product of a compound containing a nitrogen-carbon-sulfur radical of the general structural formula (A)

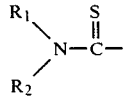

where $R_1$ and $R_2$ are alkyl radicals, a hydrogen atom or mixtures thereof, or

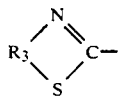

where $R_3$ is an aromatic, heterocyclic or alicyclic radical or their alkyl derivatives, and (B) a compound of the formula $$X—R_1—(S)_n—R_2—Y$$

where $R_1$ and $R_2$ are the same or different and are substituted or unsubstituted alkylene radicals containing 1 to 6 carbon atoms, X is a functional or non-functional moeity, n is 2, 3, 4, or 5, and Y is a water solubilizing group or a group capable of imparting water solubility to said reaction product, said reaction product being present in a sufficient amount to prevent formation of cracks at the corners when the plated substrate is subjected to thermal shock.

16. The method of claim 15 in which Y or said alkylene polysulfide compound is an $—SO_3H$ group.

17. The method of claim 16 in which (A) is an alkali metal salt of tetraalkylthiuram disulfide, 2,2'-dithio-bis-arylthiazole, or 2-mercaptoarylthiazole and (B) is di(3-sulfonate-1-alkyl) sulfide.

18. The method of claim 17 in which (A) is the sodium salt of tetramethylthiuram disulfide, tetraethylthiuram disulfide or mixtures thereof, 2,2'-dithio-bis-benzothiazole or 2-mercaptobenzothiazole and (B) is di(-sodium-3-sulfonate-1-propyl) sulfide.

19. The method of claim 17 in which the electroplating solution also contains a brightening and/or leveling agent.

20. The method of claim 19 in which the brightening and/or leveling agent is an oxyethylene and/or an oxypropylene group.

21. The method of claim 15 in which the reaction product is prepared from the reaction of (A), (B) and an amide compound.

22. The method of claim 21 in which Y of said alkylene polysulfide compound is an $—SO_3H$ group.

23. The method of claim 22 in which the copper salt of the electroplating solution is copper sulfate and the free acid of the electroplating solution is sulfuric acid.

24. The method of claim 22 in which said amide compound is a compound of the formula $$R—\overset{\overset{\displaystyle O}{\|}}{C}—NH_2$$

where R is a lower alkyl radical of 1 to 6 carbon atoms, a lower alkylene radical of 1 to 4 carbon atoms, an aromatic radical, or a hydrogen atom.

25. The method of claim 24 in which the electroplating solution also contains a brightening and/or leveling agent.

26. The method of claim 25 in which the agent is an oxyethylene and/or an oxypropylene polymer containing at least about 8 ethylene or propylene groups.

* * * * *